US006813833B2

(12) United States Patent
Saunders et al.

(10) Patent No.: US 6,813,833 B2
(45) Date of Patent: Nov. 9, 2004

(54) UTILITY KNIFE

(75) Inventors: Craig M. Saunders, Rocky River, OH (US); Jeffrey R. Kalman, Cleveland Heights, OH (US); Todd A. Spiegelberg, Oberlin, OH (US)

(73) Assignee: Nottingham-Spirk Design Associates, Inc., Cleveland, OH (US)

( * ) Notice: Subject to any disclaimer, the term of this patent is extended or adjusted under 35 U.S.C. 154(b) by 12 days.

(21) Appl. No.: 10/345,641

(22) Filed: Jan. 15, 2003

(65) Prior Publication Data

US 2003/0154606 A1 Aug. 21, 2003

Related U.S. Application Data

(60) Provisional application No. 60/348,878, filed on Jan. 16, 2002.

(51) Int. Cl.[7] ..... B26B 1/08

(52) U.S. Cl. ..... 30/162; 30/2; 30/125; 30/335

(58) Field of Search ..... 30/2, 125, 335, 30/162, 163

(56) References Cited

U.S. PATENT DOCUMENTS

| | | | |
|---|---|---|---|
| 2,607,987 A | 8/1952 | Bettenhausen | |
| 3,660,896 A | 5/1972 | Umholtz | |
| 3,906,627 A | 9/1975 | Manning | |
| 4,139,939 A | 2/1979 | Crooks | |
| 4,277,888 A | 7/1981 | Szabo | |
| 4,320,576 A | 3/1982 | Beermann | |
| 4,615,118 A | 10/1986 | Ihata | |
| 4,683,656 A | 8/1987 | Peyrot et al. | |
| 4,713,885 A | 12/1987 | Keklak et al. | |
| 4,835,865 A | 6/1989 | Knoop | |
| 5,303,474 A | 4/1994 | Keklak et al. | |
| 5,426,855 A | 6/1995 | Keklak et al. | |
| 5,581,890 A | 12/1996 | Schmidt | |
| 5,613,300 A | 3/1997 | Schmidt | |
| 5,617,635 A | 4/1997 | Berns | |
| 5,813,121 A | 9/1998 | Gringer | |
| 6,330,749 B1 * | 12/2001 | Khachatoorian et al. | 30/162 |

* cited by examiner

*Primary Examiner*—Douglas D. Watts
(74) *Attorney, Agent, or Firm*—Fay, Sharpe, Fagan, Minnich & McKee

(57) ABSTRACT

An improved utility knife with an ergonomically shaped handle having a cavity and a working blade holder slidably disposed within the cavity is described. A bottom release lever and a top drive lever are pivotally mounted to the handle and movable with respect to the handle for releasing and moving the working blade holder, respectively. The knife includes an extra blade holder slidably mounted to the handle and movable with respect to the handle within the cavity. The extra blade holder includes a front support end for engagement with a working blade, whereby slidable displacement of the extra blade holder disengages the support end from the working blade to allow removal and replacement of the working blade from the utility knife.

12 Claims, 3 Drawing Sheets

UTILITY KNIFE

This application claims the benefit of Provisional Application No. 60/348,878, filed Jan. 16, 2002.

The present invention relates to utility knives and more particularly, to utility knives which include an ergonomically-shaped handle and a retractable blade.

BACKGROUND OF THE INVENTION

In many utility knives, a replaceable blade or one continuous blade is fixed at one end of a knife handle. Prior art utility knives often included blades that were constantly exposed which posed a danger to people or objects that came into contact with the knife while not in use. These prior art designs often required disassembly of a two-piece knife handle in order to remove and replace a worn blade. Disassembly required additional tools was cumbersome, and risked the loss or damage of handle fastening screws and other component parts. Another design for a utility knife incorporated the use of one continuous blade. Utility knives of this type generally lack safety features and involve the use of a less structurally stable blade. The aforementioned limitations have the effect of decreasing overall utility and operator convenience. The following patents are incorporated herein by reference as background information with regard to utility knives heretofore available: U.S. Pat. No. 3,906,627 to Manning; U.S. Pat. No. 5,426,855 to Keklak; and U.S. Pat. No. 4,615,118 to Ihata.

One example of a utility knife of the prior art which attempts to overcome the aforementioned problems is shown in the patent to Manning, and generally comprises a utility knife which includes a retractable working blade. Many of these types of knives utilize a manually-operated thumb screw which requires loosening, manual sliding, and retightening in order to allow the working blade to extend beyond the handle end. Other models utilize a thumb lever which requires depression and sliding along a channel in the handle in order to extend the blade beyond the handle. Once the working blade is placed in the extended position, the blade remains fixed and subsequently acquires the inherent danger of having an exposed knife blade while the utility knife is not in use. These models also retain the cumbersome requirement of disassembling the two-piece knife handle in order to remove and replace a worn blade.

Another example of a utility knife of the prior art which attempts to overcome the aforementioned problems is shown in the patent to Keklak, and generally comprises a utility knife which includes the use of an automatically retractable blade. This patent and similar types of utility knives include the use of a spring-biased working blade which is automatically retractable into the knife handle upon release of the operating lever. In the Keklak patent, a toggle linkage is mounted between a fixed point in the handle and the blade holder. A spring which normally biases the blade holder rearwardly can be overcome when the operator squeezes a lever protruding from the bottom of the handle which results in extension of the toggle linkage, which forces the blade to its exposed position. The Keklak patent also includes a mechanism for limiting the extension of the blade by manually positioning a thumb screw which inhibits the extension of the toggle linkage. The Keklak structure does not allow one to replace a worn blade without manually separating the pieces of the handle which requires additional tools, time, and handling. All of these factors make blade replacement cumbersome.

Another version of a utility knife incorporates the use of a continuous blade which is extendable beyond the handle by either loosening or depressing a thumb screw and sliding the thumb screw along a channel in the handle. An example of this type of utility knife is described in the patent to Ihata. Typically, the continuous blade includes parallel scoring lines at predetermined intervals along the face of the blade. The scoring is used to break off the worn blade tip section which is subsequently replaced with a new section of blade tip. This version of a utility knife lacks the safety feature of an automatically retractable blade, and also typically is embodied by a non-ergonomically designed handle. In addition, the method for replacing the end of the working blade, by means of breaking off the worn tip, presents a danger of blade tips inadvertently bouncing into the air. The continuous blade also involves the use of a less structurally sound blade, resulting in decreased utility.

Consequently, there remains a need for a utility knife which is simple, inexpensive, with fewer component parts, and which overcomes the aforementioned problems. The present invention provides such a device.

SUMMARY OF THE INVENTION

Accordingly, an object of the invention is to provide a safety utility knife with a permanently sealed handle and a self-retracting working blade.

Another object of the invention is to provide a safety utility knife with an ergonomically shaped handle.

A further object of the invention is to provide dual levers for moving the working blade between a retracted (inoperative) position and an extended (operative) position.

Yet another object of the invention is to provide a utility knife having storage of extra replacement blades in the handle, and to enable replacement of a worn working blade with a replacement blade without the use of additional tools.

In accordance with the invention, a utility knife is provided which is particularly adapted to extend a working blade to the cutting position upon squeezing a pair of levers against the handle. The utility knife comprises a handle having a cavity and a forward opening, a bottom opening, a top opening, and a rear opening. A bottom release lever is pivotally mounted to the handle and movable with respect to the handle within the bottom opening. A top drive lever is pivotally mounted to the handle and movable with respect to the handle. A working blade holder is slidably disposed within the cavity of the handle and supports a working blade which is movable with respect to the handle within the forward opening. A spring biased toggle linkage connects to the working blade holder and the handle. The spring biased toggle linkage is adapted to extend upon pivoting of said top drive lever toward said handle. An extra blade holder is slidably mounted to the handle and movable with respect to the handle within the rear opening and includes a front support end for engagement with the working blade. Slidable displacement of the extra blade holder outward from the handle disengages the support end from the working blade and allows removal of the working blade from the utility knife. Once the working blade is unrestrained, an operator can easily remove and replace it with one of the extra blades.

In accordance with another aspect of the invention, a utility knife is provided which comprises a handle having a cavity. A bottom release lever is pivotally mounted to the handle and movable with respect to the handle within the cavity. A top drive lever is pivotally mounted to the handle and movable with respect to the handle. The handle includes a forward opening and a rear opening and a working blade holder slidably disposed within the handle. A working blade is supported by the working blade holder. A spring biased toggle linkage is connected to the working blade holder and the handle and is adapted to extend upon pivoting of the top drive lever toward the handle. An extra blade holder slidably mounted to the handle and movable with respect to the handle within the cavity. The extra blade holder has a slot for storing extra blades and includes a front support end for engagement with the working blade. Slidable displacement of the extra blade holder disengages the support end from the working blade and allows removal of the working blade from the utility knife.

BRIEF DESCRIPTION OF THE DRAWINGS

The invention may take physical form is certain parts and arrangements of parts, several preferred embodiments of which are described in the specification and illustrated in the accompanying drawings which form a part hereof and wherein.

DESCRIPTION OF PREFERRED EMBODIMENTS OF THE INVENTION

Figure 1:
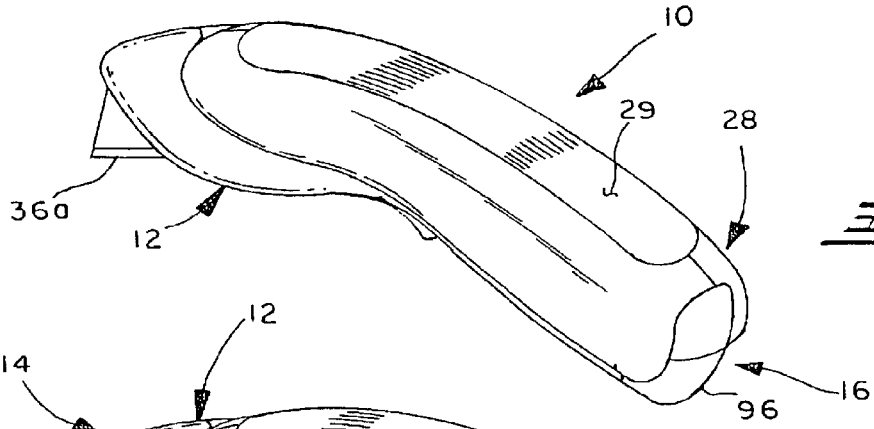
FIG. 1 is a perspective view of a utility knife in accordance with the present invention in the operative position.
Figure 2:
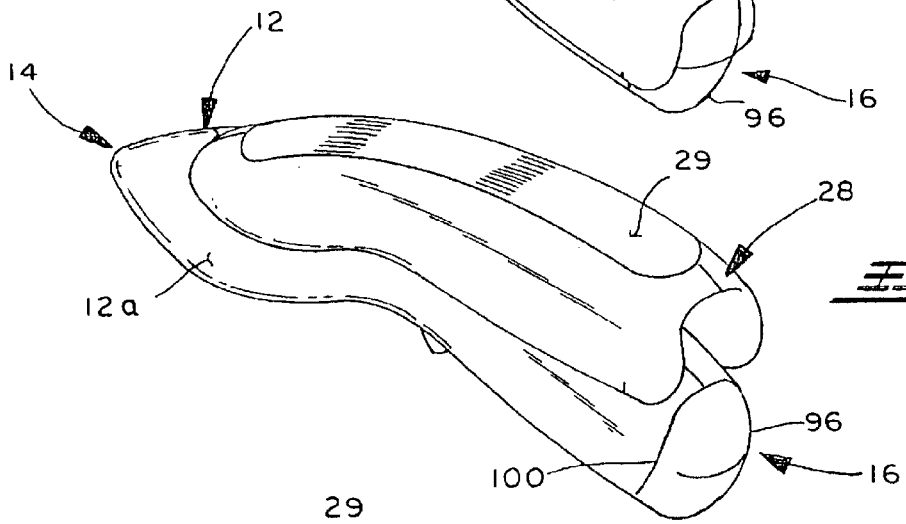
FIG. 2 is a perspective view of a utility knife in accordance with the present invention in the inoperative position.
Figure 3:
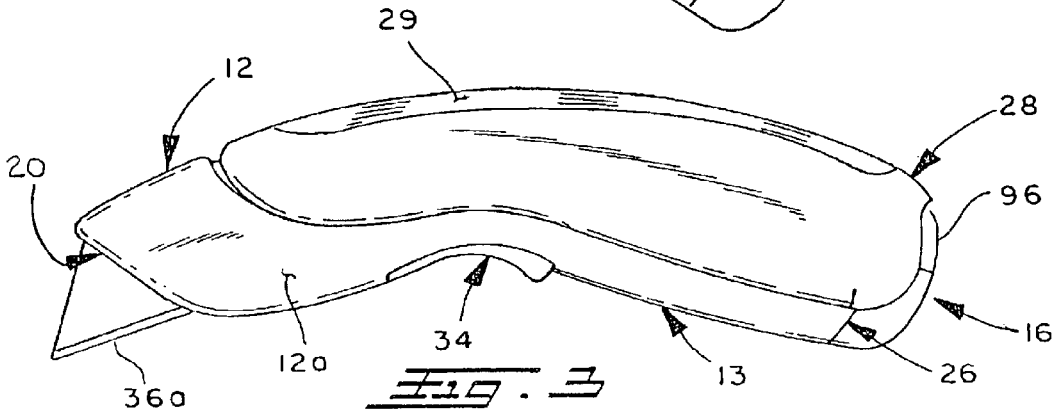
FIG. 3 is a side elevation view of a utility knife in accordance with the present invention in the operative position.
Figure 5:
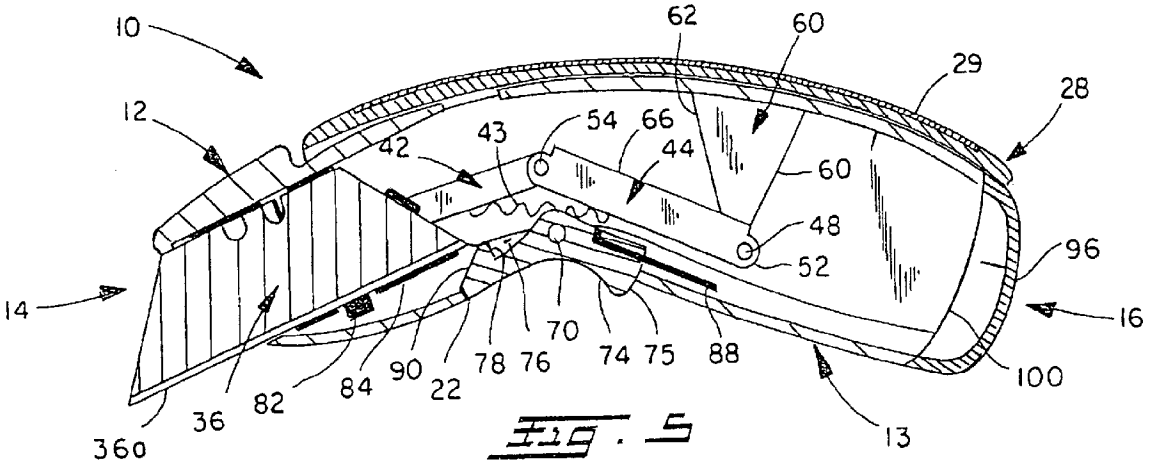
FIG. 5 is a side sectional view of a utility knife in accordance with the present invention in the operative position.
Figure 6:
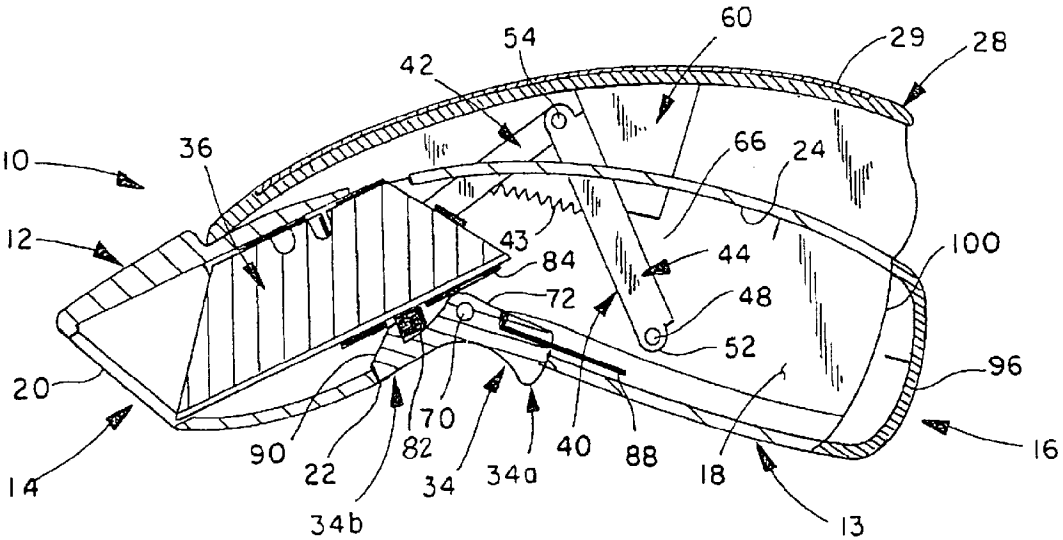
FIG. 6 is a side sectional view of a utility knife in accordance with the present invention in the inoperative position; and, FIG. 7 is an exploded view of a utility knife in accordance with the present invention.

Referring now in greater detail to the drawings, wherein the showings are for the purpose of illustrating preferred embodiments of the invention only, and not for the purpose of limiting the invention, a safety utility knife 10 according to the invention is shown in FIGS. 1–4. The utility knife 10 comprises an ergonomically shaped, permanently sealed handle 12 with a front end 14 and a rear end 16. The handle 12 surrounds an internal cavity 18 (FIGS. 5 and 6) having a forward opening 20, a bottom opening 22, a top opening 24, and a rear opening 26. The handle 12 further includes connections to a top drive lever 28 and a bottom release or safety lever 34. FIGS. 1 and 3 illustrate the utility knife 10 in accordance with the present invention in the operative or cutting position with a working blade 36 partially extended beyond the front end 14 of the knife handle 12, as will be described more fully herein. Handle 12 is formed from left and right halves 12*a*, 12*b*, respectively which are permanently sealed together. The top drive lever 28 is supported on pins 30, 31 whose ends are supported in opposed holes (not shown) near the front 14 of the handle 12. The top drive lever 28 and the handle 12 are pivotally connected. In addition, the top drive lever 28 is connected to a spring-biased toggle linkage 40 (FIGS. 5 and 6). A working blade holder 38 is moved forward and rearward by the toggle linkage 40. The toggle linkage 40 includes a front link 42, a spring 43 (i.e. coil spring), and a rear link 44. The front link 42 has a front pin 46 connected to the working blade holder 38 and the rear link 44 has a rear pin 48 connected to a stationary mount 52 on the handle 12. The toggle linkage 40 further includes a central hinge pin 54. The top drive lever 28 includes an abutment member 60 generally transverse to a removable top plate 29 of the top drive lever 28. A front edge 62 of the abutment member 60 is slidingly engaged with a back edge 66 of the rear link 44. When the top drive lever 28 is moved downward towards the handle 12, the spring 43 biasing force is overcome and toggle linkage 40 straightens. The links 42, 44, become more nearly colinear, forcing the working blade holder 38, which is slidably disposed within the cavity 18, toward the front end 14 of the handle 12. The working blade holder 38 supports a working blade 36. A portion 36*a* of the working blade 36 projects forwardly from the working blade holder 38. The movement of the working blade holder 38 toward the forward opening 20 results in a portion of the working blade 36*a* projecting outwardly of the forward opening 20 of the handle 12. As shown in FIG. 5, a portion of the working blade 36*a* is thus projected out of the forward opening 20 of the handle 12 in its operative or cutting position.

The bottom release lever 34 is pivotally mounted on a central pin 70 which is fixed to the handle halves 12*a*, 12*b*. The release lever 34 extends through the bottom opening 22. The release lever 34 pivots from a first position to a second position. The first position corresponds to the inoperative or retracted position of the working blade 36. The bottom release lever 34 includes a top side 72, a bottom side 74, a rear portion 34*a*, and a front portion 34*b*. The top side 72 includes a recess 76 and an edge 78. The edge 78 projects transversely to the top side 72 of the bottom release lever 34 at the front of the recess 76. The bottom side 74 of the bottom release lever 34 is curvilinear and configured for engagement with an operator's finger. In the first position, a projection 82 on a bottom side 84 of the working blade holder 36 is restrained by the recess 76 and edge 78 along the top side 72 of the bottom release lever. This restraint prevents forward movement of working blade holder 38. In the second position, the rear portion 34*a* is pushed upward (by finger pressure) into cavity 18 which pivots front portion 34*b* downward thereby releasing the projection 82 from the recess 76 and edge 78, which allows forward movement of working blade holder 38.

The bottom release lever 34 further includes a springlike biasing arm 88 projecting from a rear side 75. The biasing arm 88 rests upon a bottom side 13 of the handle 12 and biases the bottom release lever 34 into the first position when no finger pressure is applied. The front 73 of the bottom release lever 34 includes a sloping face 90 which allows the projection 82 of the working blade holder 38 to move rearwardly across and over the sloping face 90 in order to allow the working blade holder 38 to retract within the cavity 18 of the handle 12 in the absence of finger pressure on the release lever 34. It will be appreciated that the bottom release lever 34 is depressed by finger pressure prior to or simultaneous with the depression of the top drive lever 28 in order to move the working blade holder 38 towards the front end 14 of the handle 12 and thereby allow partial extension of the working blade 36 beyond the forward opening 20 of the handle 12. In the absence of finger pressure, the recess 76 and edge 78 engage the projection 82 of the working blade holder 38 such that forward movement of the working blade holder 38 is prohibited. The bottom release lever 34 represents a safety latch which necessitates that the rear portion 34*a* of the bottom release lever 34 be compressed prior to or simultaneous with the top drive lever 28 in order for a portion of the working blade 36*a* to advance forward of the forward opening 20 of the handle 12.

FIGS. 1 and 3 show the utility knife 10 in the operative or working position. As such, when an operator grips the utility knife 10 in the palm of the hand, the rear portion 34*a* of the bottom release lever 34 is pushed upward into the cavity 18 of the handle 12 with one or more of the operator's fingers, releasing the working blade holder 38, and the top drive lever 28 is then compressed downward over the handle 12. Upon further compression of top drive lever 28, the extension of the working blade 36 progresses by means of the spring-biased toggle linkage 40 which is connected to the working blade holder 38 and the handle 12.

Figure 4:
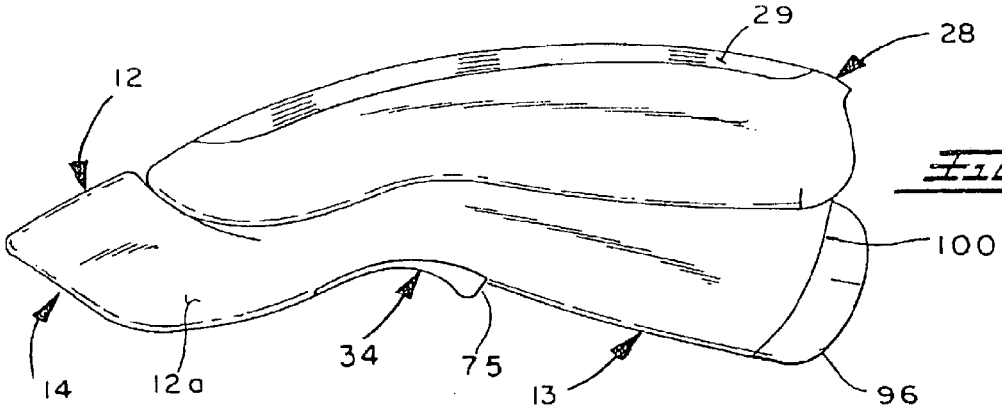
FIG. 4 is a side elevation view of a utility knife in accordance with the present invention in the inoperative position.

FIGS. 2 and 4 show the utility knife 10 in the inoperative or retracted position. As such, when an operator releases the grip of the utility knife 10, the spring-biased toggle linkage 40 moves to the retracted position whereby the top drive lever 28 moves upward and the working blade holder 38 retracts rearward in the cavity 18 of the handle 12. The spring 43 which normally biases the toggle linkage 40 and attached working blade holder 38 rearward can be overcome when the operator squeezes the top drive lever 28 extending from a top wall 15 of the handle 12 which results in extension of the toggle linkage 40, which forces the working blade 36 to its exposed position (FIG. 5). The operator is then able to use the utility knife 10 in the desired manner. Simultaneous or sequential compression of the bottom release lever 34 and the top drive lever 28 to initiate extension of the working blade 36 represents one of the safety features of the utility knife 10. Upon releasing the drive lever 28, the working blade 36 will automatically retract into the handle 12 by means of the spring-biased toggle linkage 40. The working blade 36, when retracted, is always entirely within the cavity 18 of the handle 12 so as to obviate the danger inherent in an extended and exposed blade. The retraction of the working blade 36 upon release of the drive lever 28 will occur through intentional efforts of the operator as well as inadvertent efforts due to operator dropping the utility knife 10 while the utility knife 10 is in the operative position. This automatic retraction of the working blade 36 incorporates another safety feature of the utility knife 10. FIGS. 5 and 6 show the relationship between the top drive lever 28, the bottom release lever 34, the spring-biased toggle linkage 40, and the working blade holder 38.

Figure 7:
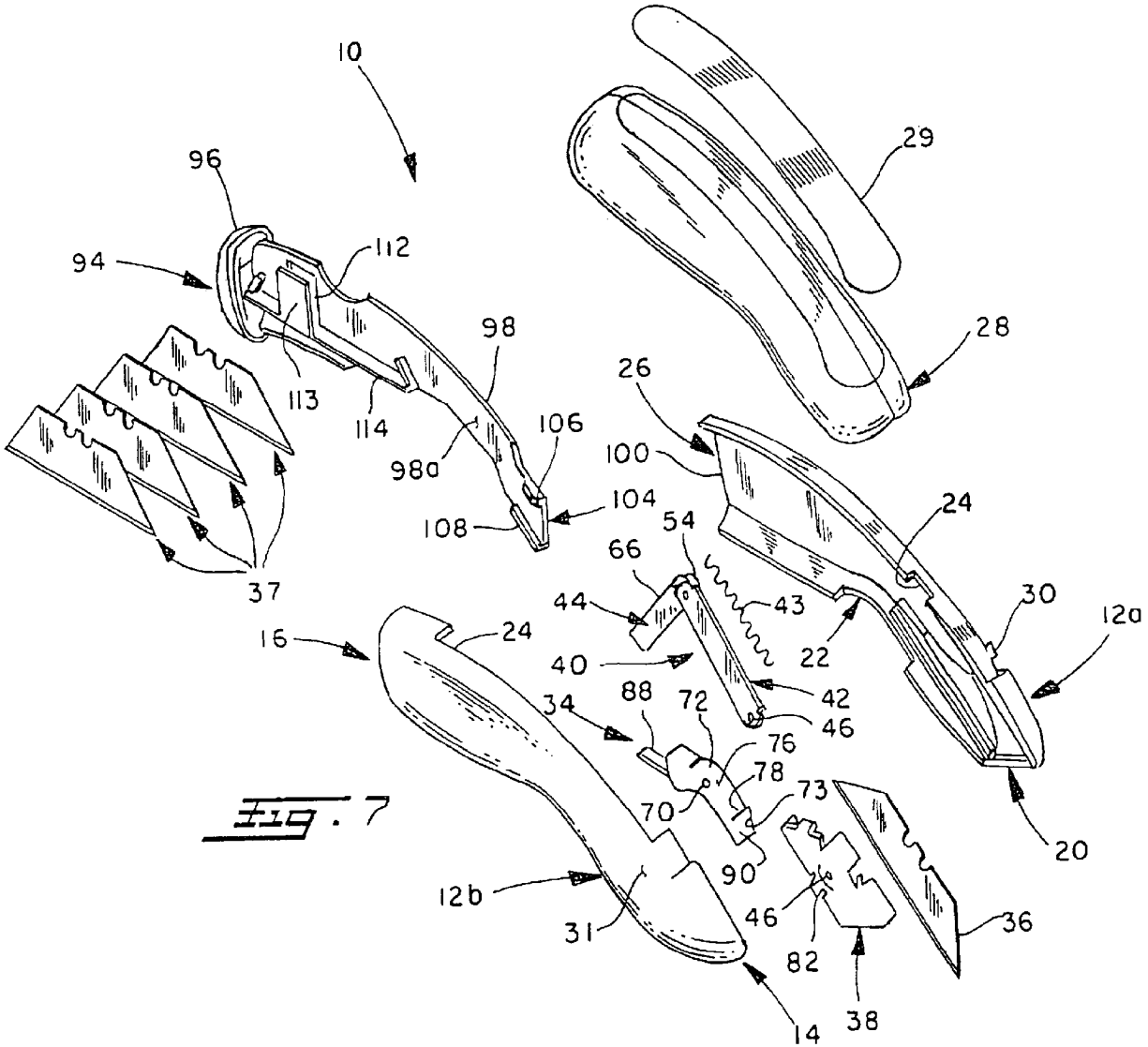

The utility knife 10 further includes an extra blade holder 94 slidably mounted to the handle 12 and movable with respect to the handle 12 within the cavity 18. In FIGS. 5 and 6, the extra blade holder 94 is in the mounted position within the cavity 18 of the handle 12. The extra blade holder 94 extends within and without a rear opening 26 in the handle 12. The extra blade holder 94 includes an end cap 96 and a leg 98 extending transverse to the end cap 96. The leg 98 extends toward the front 14 of the handle 12. The extra blade holder 94 frictionally engages the interior surface of the handle 12. The leg 98 includes two faces 98*a*, 98*b*. As shown in FIG. 7, the extra blade holder 94 further includes a front support end 104 which further supports the working blade 36. The front support end 104 includes an upper flange 106 and a lower flange 108 extending transverse to face 98*a*. When the extra blade holder 94 is in the mounted position, the flanges 106, 108 frictionally engage an exposed face of the working blade 36, thereby retaining the working blade 36 in the working blade holder 38. The extra blade holder 94 also includes an integrated slot 112 and support arm 114 for storage of extra blades 37. Slot 112 is formed between a flange 113 and leg 98 with the extra blades 37 stored edge down (i.e. edge(s) proximal to support arm 114).

The procedure for replacing a worn working blade 36 is a simple process for the operator. An operator extends the extra blade holder 94 from the rear opening 26 of the handle 12. This extension allows access to the extra blades 37. As the extra blade holder 94 is moved outwardly in the extended position, the front support end 104 is pulled rearward within the cavity 18 of the handle 12 and away from the working blade 36. This movement releases the working blade 36 from the working blade holder 38 and allows extraction of the working blade 36 from the forward opening 20 of the handle 12. Next, the operator removes an extra blade 37 from the slot 112 in the extra blade holder 94 and manually inserts it into the forward opening 20 of the handle 12. Finally, pushing the extra blade holder 94 inward into the cavity 18 of the handle 12 causes the front support end 104 of the extra blade holder 94 to reengage the working blade 36 and secure it with the working blade holder 38.

FIG. 7 displays an exploded view of the major component parts of the utility knife 10. The handle 12 is generally comprised of two halves 12*a*, 12*b* that form a cavity 18. The two halves 12*a*, 12*b* of the handle 12 remain permanently affixed during operation and during replacement of a worn working blade 36 with an extra blade 37, etc. As discussed above, the cavity 18 defined by the two halves 12*a*, 12*b* allows movement of the internal component parts, specifically, the working blade 36, the working blade holder 38, the toggle linkage 40, the bottom release lever 34, and the extra blade holder 94.

The invention has been described with reference to several embodiments, obviously, modifications and alterations will occur to others upon a reading and understanding of this specification. It is intended to include all such modifications and alterations insofar as they come within the scope of the appended claims and the equivalents thereof.

Having thus described the invention, it is claimed:

1. A utility knife comprising:

a handle having a cavity and a forward opening, a bottom opening, a top opening, and a rear opening;

a bottom release lever pivotally mounted to said handle and movable with respect to said handle within said bottom opening;

a top drive lever pivotally mounted to said handle and movable with respect to said handle;

a working blade holder slidably disposed within said cavity of said handle;

a working blade supported by said working blade holder and movable with respect to said handle within said forward opening;

a spring-biased toggle linkage connected to said working blade holder and said handle, adapted to extend upon pivoting of said top drive lever toward said handle;

an extra blade holder slidably mounted to said handle and movable with respect to said handle within said rear opening;

said extra blade holder includes a front support end for engagement with said working blade;

whereby slidable displacement of said extra blade holder outward from said handle disengages said support end from said working blade to allow removal of said working blade from said utility knife.

2. The utility knife of claim 1, wherein said extra blade holder includes a slot in one side for storage of and access to extra blades.

3. The utility knife of claim 1, wherein said extra blade holder is slidably removable from said handle.

4. The utility knife of claim 1, wherein said working blade is removable from said working blade holder through said forward opening.

5. The utility knife of claim 1, whereby said working blade holder moves toward said forward opening by sequentially squeezing said bottom release lever and said top drive lever.

6. The utility knife of claim 1, whereby said working blade holder moves toward said forward opening by simultaneously squeezing said bottom release lever and said top drive lever.

7. The utility knife of claim 1, wherein said handle is permanently sealed.

8. The utility knife of claim 1, wherein said drive lever is slidingly engaged with said spring biased toggle linkage.

9. A utility knife comprising:

a handle having a cavity;

a bottom release lever pivotally mounted to said handle and movable with respect to said handle within said cavity;

a top drive lever pivotally mounted to said handle and movable with respect to said handle;

said handle including a forward opening and a rear opening, a working blade holder slidably disposed within said handle;

a working blade supported by said working blade holder;

a spring-biased toggle linkage connected to said working blade holder and said handle, adapted to extend upon pivoting of said top drive lever toward said handle;

an extra blade holder slidably mounted to said handle and movable with respect to said handle within said cavity;

said extra blade holder having a slot for storing extra blades;

said extra blade holder including a front support end for engagement with said working blade; and, whereby slidable displacement of said extra blade holder disengages said support end from said working blade to allow removal of said working blade from said utility knife.

10. The utility knife of claim 9, wherein said slot is in one side of said extra blade holder.

11. The utility knife of claim 9, wherein said extra blade holder is slidably removable from said handle through said rear opening.

12. The utility knife of claim 9, wherein said top drive lever is slidingly engaged with said spring biased toggle linkage.

* * * * *